US008435059B2

(12) United States Patent
Honda et al.

(10) Patent No.: US 8,435,059 B2
(45) Date of Patent: May 7, 2013

(54) HOLDING MEMBER TO HOLD A CONNECTING OBJECT CONNECTABLE TO A CONNECTOR HAVING AN ACTUATOR

(75) Inventors: Yosuke Honda, Tokyo (JP); Hiroyuki Yokoo, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 13/228,674

(22) Filed: Sep. 9, 2011

(65) Prior Publication Data

US 2012/0064748 A1 Mar. 15, 2012

(30) Foreign Application Priority Data

Sep. 9, 2010 (JP) ..... 2010-202464

(51) Int. Cl.
*H01R 13/15* (2006.01)

(52) U.S. Cl.
USPC ..... 439/260; 439/445

(58) Field of Classification Search ..... 439/260, 439/445
See application file for complete search history.

(56) References Cited

U.S. PATENT DOCUMENTS

| | | | | |
|---|---|---|---|---|
| 4,684,183 | A * | 8/1987 | Kinoshita et al. | 439/77 |
| 4,695,112 | A * | 9/1987 | Maston et al. | 439/350 |
| 6,042,410 | A * | 3/2000 | Watanabe | 439/269.1 |
| 6,089,905 | A * | 7/2000 | Shimmyo et al. | 439/495 |
| 6,162,083 | A * | 12/2000 | Seto | 439/328 |
| 6,361,358 | B1 * | 3/2002 | Kajinuma | 439/497 |
| 6,428,338 | B1 * | 8/2002 | Yasufuku et al. | 439/310 |
| 6,558,186 | B1 * | 5/2003 | LePottier et al. | 439/496 |
| 6,669,503 | B2 | 12/2003 | Hirose | |
| 6,949,316 | B2 | 9/2005 | Aoki | |
| 7,134,891 | B2 * | 11/2006 | Kayama et al. | 439/260 |
| 7,179,118 | B1 * | 2/2007 | Harlan et al. | 439/495 |
| 7,625,231 | B2 * | 12/2009 | Takahira | 439/495 |
| 7,887,351 | B2 * | 2/2011 | Wang et al. | 439/260 |
| 8,133,067 | B2 * | 3/2012 | Tsai et al. | 439/260 |
| 2006/0292911 | A1 * | 12/2006 | Ning | 439/260 |
| 2007/0054545 | A1 * | 3/2007 | Takahira | 439/495 |
| 2012/0064748 | A1 * | 3/2012 | Honda et al. | 439/260 |
| 2012/0258618 | A1 * | 10/2012 | Sasaki et al. | 439/260 |

FOREIGN PATENT DOCUMENTS

| | | | |
|---|---|---|---|
| JP | 2002-367730 | A | 12/2002 |
| KR | 10-2004-0108566 | A | 12/2004 |

OTHER PUBLICATIONS

Korean Office Action dated Jul. 24, 2012 (and English translation thereof) in counterpart Korean Application No. 10-2011-0086992.

* cited by examiner

*Primary Examiner* — James Harvey
(74) *Attorney, Agent, or Firm* — Holtz, Holtz, Goodman & Chick, P.C.

(57) ABSTRACT

A holding member is configured to hold a sheet-like or board-like connecting object. The connecting object held by the holding member is able to be inserted into and connected to a connector which includes an actuator having an actuator-side engaged portion. The holding member comprises a holder-side engaged portion. The holder-side engaged portion is engaged with the actuator-side engaged portion when the actuator is turned over under a state where the connecting object held by the holding member is inserted in the connector. The turning over of the actuator connects the connector to the connecting object. The engagement of the holder-side engaged portion with the actuator-side engaged portion keeps a predetermined relative position of the connecting object relative to the connector.

18 Claims, 4 Drawing Sheets

HOLDING MEMBER TO HOLD A CONNECTING OBJECT CONNECTABLE TO A CONNECTOR HAVING AN ACTUATOR

CROSS REFERENCE TO RELATED APPLICATIONS

Applicants claim priority under 35 U.S.C. §119 of Japanese Patent Application No. JP2010-202464 filed Sep. 9, 2010.

BACKGROUND OF THE INVENTION

This invention relates to a holding member which is configured to hold a sheet-like or a board-like connecting object. For example, the connecting object is a Flexible Flat Cable (FFC) or a Flexible Printed Circuit (FPC). This invention further relates to a connector assembly which comprises the holding member and a connector configured to be connected to the connecting object held by the holding member. The connector assembly is able to be installed in an electronic apparatus. For example, the electronic apparatus is a liquid crystal television or a plasma television.

For example, a connector connectable to an FFC or an FPC is disclosed in JP-A 2002-367730, contents of which are incorporated herein by reference. The connector of JP-A 2002-367730 has an actuator. The connecting object is connected to the connector by turning over the actuator in a state where the connecting object is inserted into the connector.

The connecting object inserted into the connector may be moved unexpectedly by the actuator when the actuator is turned over. When the connecting object moves in an improper direction, the connecting object might not be connected to the connector properly.

SUMMARY OF THE INVENTION

It is therefore an object of the present invention to provide an assistant tool which assists a connecting object to be connected properly to a connector including an actuator.

More specifically, the present invention provides a holding member as the aforementioned assistant tool. The holding member is configured to hold a sheet-like or a board-like connecting object which is inserted into and connected to a connector including an actuator having an actuator-side engaged portion. For example, the holding member is configured to be mated with the connector when the holding member is partially inserted into the connector while holding the connecting object.

One aspect of the present invention provides a holding member configured to hold a sheet-like or a board-like connecting object. The connecting object is able to be inserted into a connector including an actuator having an actuator-side engaged portion. The connecting object is connectable to the connector by turning over the actuator when the connecting object is inserted into the connector. The holding member comprises a holder-side engaged portion. The holder-side engaged portion is configured to be engaged with the actuator-side engaged portion when the actuator is turned over under an inserted state where the connecting object held by the holding member is inserted into the connector. An engagement of the holder-side engaged portion with the actuator-side engaged portion keeps a predetermined relative position of the connecting object relative to the connector.

Another aspect of the present invention provides a connector assembly. The connector assembly comprises the holding member described above and a connector. The connector is connectable to a connecting object held by the holding member.

An appreciation of the objectives of the present invention and a more complete understanding of its structure may be had by studying the following description of the preferred embodiment and by referring to the accompanying drawings.

Figure 1:
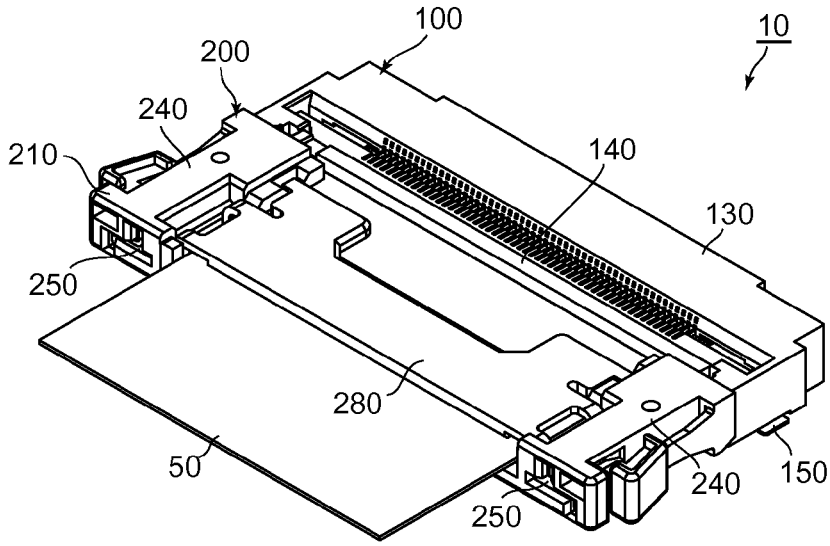
FIG. 1 is a perspective view showing a connector assembly according to an embodiment of the present invention, wherein a holding member of the connector assembly and a connector of the connector assembly are mated with each other so that the connector is connected to an FPC/FFC held by the holding member.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 8:
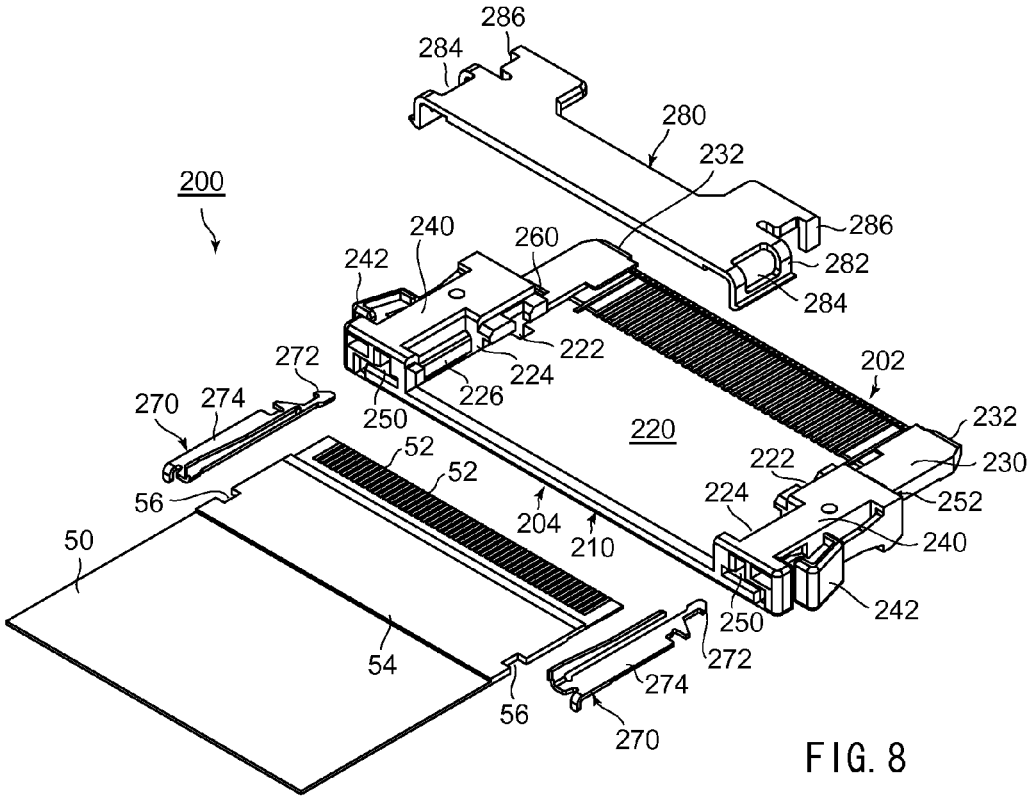
FIG. 8 is an exploded, perspective view showing the holding member of FIG. 1.

As shown in FIGS. 1 to 5, a connector assembly 10 according to an embodiment of the present invention comprises a connector 100 and a holding member 200. The connector 100 is connectable to an FPC/FFC (a sheet-like or a board-like connecting object) 50. The holding member 200 is used as an assistant tool when the FPC/FFC 50 is connected to the connector 100. Referring to FIG. 8, the FPC/FFC 50 includes a plurality of terminals 52. The terminals 52 are formed in the vicinity of an end of the FPC/FFC 50. The FPC/FFC 50 according to the present embodiment is formed with the terminals 52 not only on an upper surface thereof but also on a lower surface thereof. The FPC/FFC 50 illustrated in FIG. 8 has a strengthened portion 54. The strengthened portion 54 is provided with two cuts 56. The two cuts 56 are formed on opposite ends of the strengthened portion 54 in the lateral direction (the pitch direction), respectively. Each of the cuts 56 is depressed inward in the pitch direction.

Figure 7:
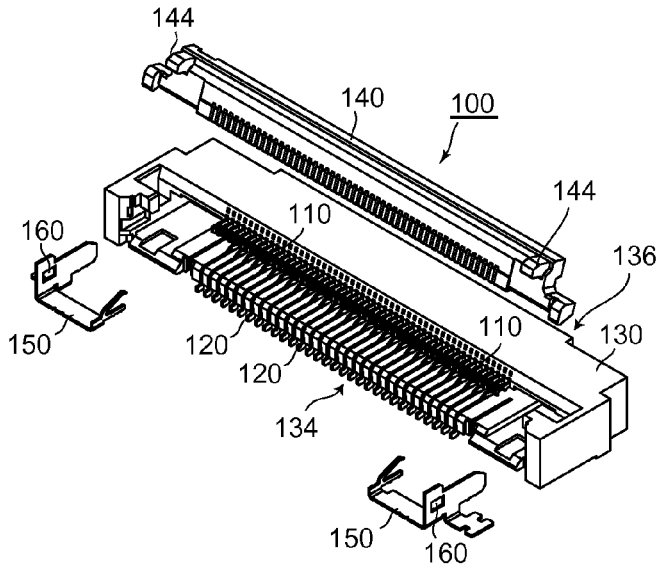
FIG. 7 is an exploded, perspective view showing the connector of FIG. 1.

Referring to FIG. 7, the connector 100 according to the present embodiment includes a plurality of first contacts 110 each made of a metal, a plurality of second contacts 120 each made of a metal, a housing 130 made of an insulating material, an actuator 140 made of an insulating material and two hold-downs 150 each made of a metal.

Figure 2:
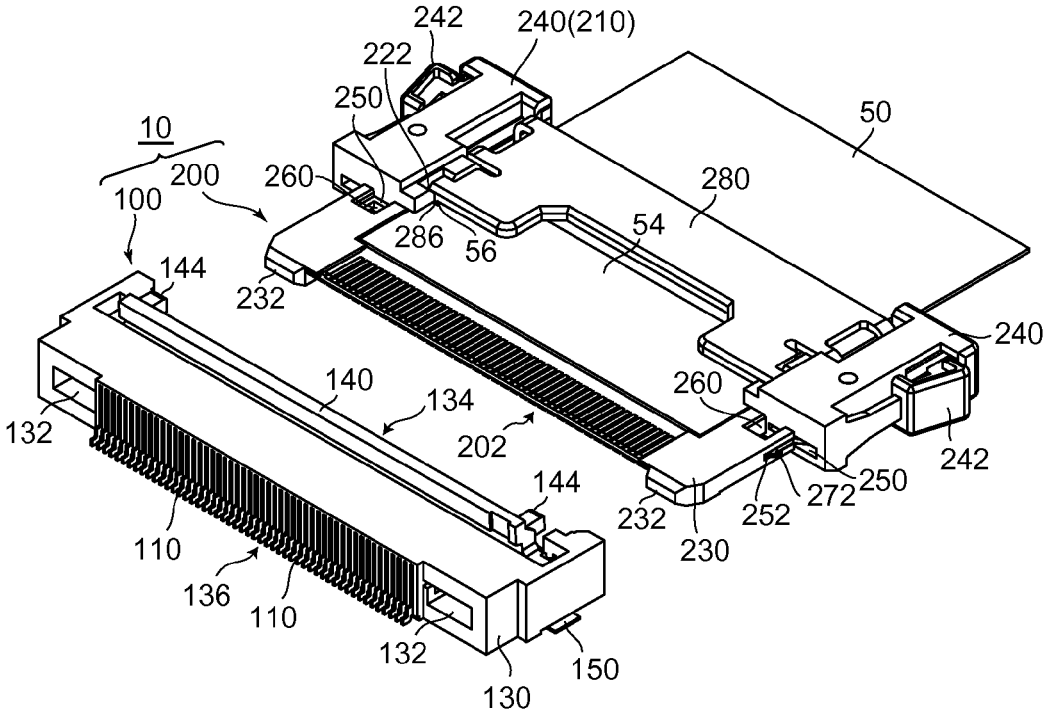
FIG. 2 is another perspective view showing the connector assembly of FIG. 1, wherein the holding member holding the FPC/FFC and the connector are removed from each other.
Figure 3:
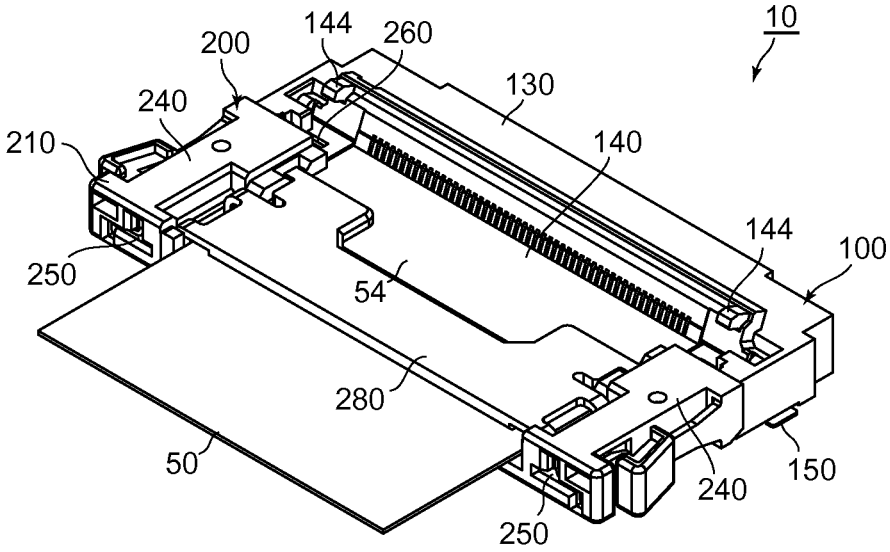
FIG. 3 is another perspective view showing the connector assembly of FIG. 1, wherein an actuator of the connector is in an open state so that the connector is not connected to the FPC/FFC.
Figure 4:
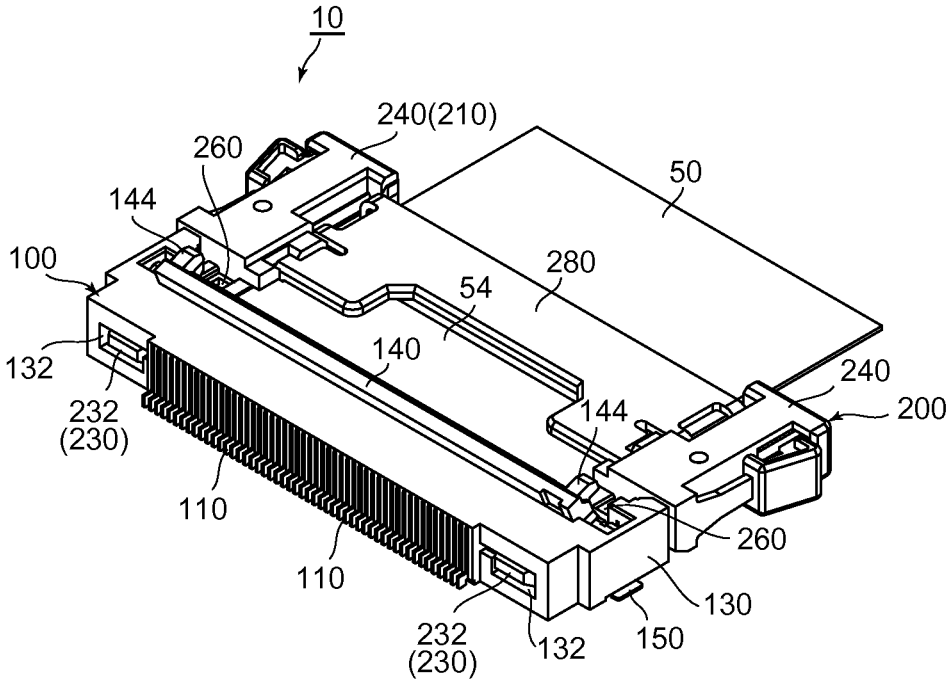
FIG. 4 is another perspective view showing the connector assembly of FIG. 3, as seen along a different direction of FIG. 3.
Figure 5:
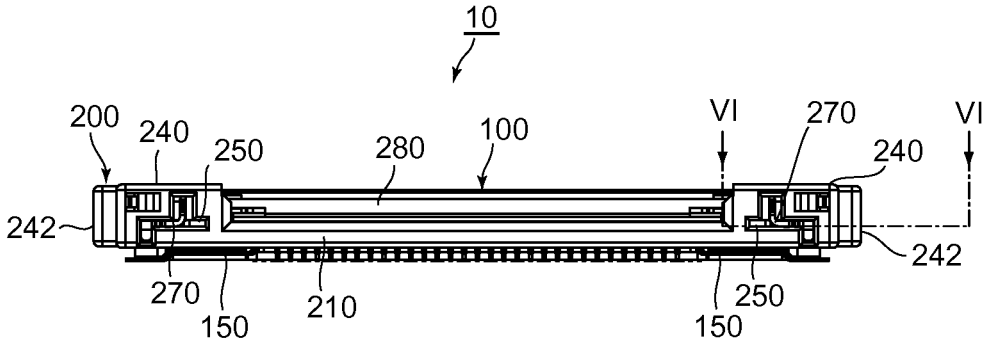
FIG. 5 is a front view showing the connector assembly of FIG. 1.

As shown in FIGS. 2 and 7, the housing 130 has a front end 134 and a rear end 136. The first contacts 110 are press-fitted into the housing 130 from the rear end 136 toward the front end 134 so that the first contacts 110 are held by and fixed to the housing 130. The second contacts 120 are press-fitted into the housing 130 from the front end 134 toward the rear end 136 so that the first contacts 110 are held by and fixed to the housing 130. The first contacts 110 and the second contacts 120 are held by the housing 130 so as to be arranged in the pitch direction.

As shown in FIG. 2, the housing 130 is provided with two mating holes 132. The two mating holes 132 are located near opposite ends of the housing 130 in the pitch direction, respectively. The mating holes 132 extend from the rear end 136 of the housing 130 toward the front end 134 of the housing 130. Each of the mating holes 132 reaches a part (not shown) which is formed at the front side (i.e. in the vicinity of the front end 134) of the housing 130 so as to receive the holding member 200 and to be mated with the holding member 200.

Referring to FIGS. 1, 2 and 7, the actuator 140 is held by the housing 130 so as to be pivotable between an open position and a close position, wherein the open position is a position where the FPC/FFC 50 is able to be inserted into the connector 100 (see FIGS. 2 to 4), while the close position is a position where the FPC/FFC 50 inserted in the connector 100 is held securely by the connector 100 (see FIG. 1). The actuator 140 according to the present embodiment pivots from the open position toward the close position when being turned toward the front end 134 of the housing 130. The actuator 140 is formed with two projecting portions (actuator-side engaged portions) 144. The two projecting portions 144 are located at opposite ends of the actuator 140 in the pitch direction, respectively. Each of the projecting portions 144 is formed so as to project downward along the vertical direction perpendicular to the pitch direction when the actuator 140 is turned over and located at the close position.

Referring to FIG. 7, each of the hold-down 150 of the connector 100 is formed with an engaged hole (connector-side lock portion) 160. The engaged hole 160 is formed as a slit so that the engaged hole 160 pierces a part of the hold-down 150 in the pitch direction while extending in the front-to-rear direction (i.e. direction extending from the front end 134 toward the rear end 136) perpendicular to the pitch direction and the vertical direction.

The FPC/FFC 50 is able to be inserted into the connector 100 along the front-to-rear direction. The connector 100 is configured so that the terminal 52 of the FPC/FFC 50 is connected to both the first contact 110 and the second contact 120 when the actuator 140 is turned to the close position under a state where the FPC/FFC 50 is inserted into the connector 100. In other words, the FPC/FFC 50 is connectable to the connector 100 by turning over the actuator 140 when the FPC/FFC 50 is inserted into the connector 100.

The holding member 200 according to the present embodiment is configured to hold the FPC/FFC 50. The holding member 200 is configured to enable the FPC/FFC 50 held by the holding member 200 to be inserted into and connected to the connector 100. Moreover, the holding member 200 functions as a positioner which properly keeps a relative position of the FPC/FFC 50 relative to the connector 100 when the FPC/FFC 50 is connected to the connector 100. More specifically, the holding member 200 according to the present embodiment is partially inserted into and mated with the connector 100 when the FPC/FFC 50 is connected to the connector 100. The aforementioned mating of the holding member 200 with the connector 100 forces the FPC/FFC 50 to be placed at a proper relative position relative to the connector 100 so that it is possible to prevent a poor contacting which tends to be caused when the FPC/FFC 50 is placed at an improper relative position.

As shown in FIG. 8, the holding member 200 according to the present embodiment comprises a body 210 made of an insulating material, two locking members 270 each made of a metal, and a cover 280. The holding member 200 has a front end 202 and a rear end 204. When the FPC/FFC 50 held by the holding member 200 is about to be inserted into the connector 100, the front end 202 of the holding member 200 faces the front end 134 of the connector 100 (see FIG. 2).

Referring to FIG. 8, the body 210 includes a mount portion 220 which has a board-like shape. The mount portion 220 is provided on a middle portion of the body 210 in the pitch direction. The FPC/FFC 50 is mounted on the mount portion 220 so as to be held by the holding member 200. The mount portion 220 is formed with two receivers 222 each of which pierces the mount portion 220 along the vertical direction. The two receivers 222 are located near opposite ends of the mount portion 220 in the pitch direction, respectively. The receivers 222 correspond to the cuts 56 formed on the strengthened portion 54 of the FPC/FFC 50. More specifically, when the FPC/FFC 50 is mounted on the mount portion 220, the two cuts 56 are able to be located on the two receivers 222, respectively. The body 210 further includes two fitting grooves 224 each of which is formed behind the receiver 222 (i.e. formed at the rear side of the body 210) in the front-to-rear direction. Each of the fitting grooves 224 is formed with a protrusion 226. The protrusion 226 protrudes inward in the pitch direction.

As shown in FIG. 8, the body 210 is formed with a mating portion 230. The mating portion 230 is located in front of the mount portion 220 (i.e. located toward the front end 202 of the body 210) in the front-to-rear direction. The mating portion 230 is configured to be inserted into and mated with the connector 100 when the FPC/FFC 50 held by the holding member 200 is inserted into the connector 100. The mating portion 230 includes two mating protrusions 232 formed on opposite ends thereof in the pitch direction, respectively. The mating protrusions 232 protrude forward so that the mating protrusions 232 are inserted into the respective mating holes 132 when the mating portion 230 is mated with the connector 100.

Figure 6:
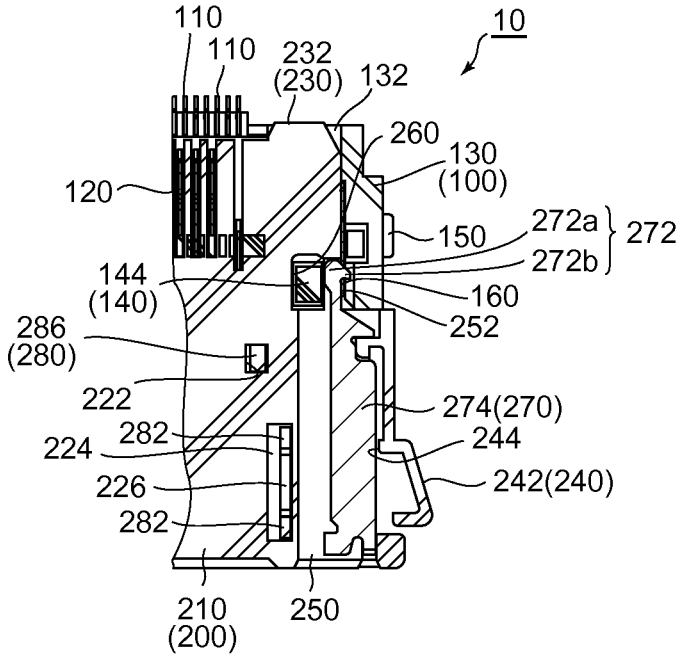
FIG. 6 is a partial, cross-sectional view showing the connector assembly of FIG. 5, taken along lines VI-VI.

As shown in FIG. 8, the body 210 includes two handling portions 240 formed on opposite ends thereof in the pitch direction, respectively. The handling portions 240 are held by an operator when the FPC/FFC 50 held by the holding member 200 is inserted into or removed from the connector 100. Each of the handling portions 240 includes a pressed portion 242. The pressed portion 242 is formed so as to be elastically deformable. The pressed portion 242 is configured to be pressed by the operator. Referring to FIG. 6, the pressed portion 242 is provided with a biasing portion 244. The biasing portion 244 is located at the inside of the pressed portion 242 in the pitch direction. The biasing portion 244 is configured to apply a force to the locking member 270 when the pressed portion 242 is pressed.

As shown in FIGS. 2, 6 and 8, each of the handling portions 240 is formed with an accommodating portion 250 which accommodates the locking member 270. The accommodating portion 250 extends from the rear end 204 toward the front end 202 so that the accommodating portion 250 arrives at the interior of the mating portion 230. The mating portion 230 has two slits 252 formed on opposite end surfaces thereof in the pitch direction, respectively. Each of the accommodating portions 250 communicates with the exterior of the holding member 200 through the slit 252.

As shown in FIGS. 2 and 6, the mating portion 230 is formed with two receiving portions (holder-side engaged portion) 260. The receiving portion 260 is configured to be engaged with the projecting portion 144 when the actuator 140 is turned to the close position under an inserted state where the FPC/FFC 50 held by the holding member 200 is inserted into the connector 100. In other words, the receiving portion 260 according to the present embodiment is receivable the projecting portion 144 when the actuator 140 is turned over under a mated sate where the holding member 200 is mated with the connector 100. The receiving portion 260 according to the present embodiment is a hole piercing the mating portion 230 along the vertical direction. However, the receiving portion 260 may have another shape corresponding to a shape of the projecting portion 144. For example, the receiving portion 260 may be a hole having a bottom.

The receiving portion 260 according to the present embodiment communicates with the accommodating portion 250. In the front-to-rear direction, the receiving portion 260 is located at substantially the same position as the position at which the slit 252 is located. In the pitch direction, the receiving portion 260 is located inside of the slit 252.

As shown in FIGS. 6 and 8, the locking member 270 has a lock portion 272 and a support portion 274 supporting the lock portion 272. The lock portion 272 according to the present embodiment is supported by the support portion 274 so as to be movable in the pitch direction.

The lock portion 272 according to the present embodiment has a hook-like shape which projects outward in the pitch direction. The lock portion 272 accommodated in the accommodating portion 250 is designed to be located at a lockable position where the lock portion 272 is able to be interlocked with the engaged hole 160 of the connector 100. In detail, the lock portion 272 according to the present embodiment has a base 272*a* and a hook 272*b*. When the lock portion 272 is located at the lockable position, the base 272*a* is accommodated within the mating portion 230 so as to be located between the receiving portion 260 and the hook 272*b* in the pitch direction. The hook 272*b* of the lock portion 272 located at the lockable position projects from the base 272*a* along the pitch direction outward over the slit 252.

As shown in FIG. 6, when the lock portion 272 is located at the lockable position, the biasing portion 244 is located in the vicinity of the support portion 274 so as to face the support portion 274 in the pitch direction from the outside of the accommodating portion 250. Therefore, when the pressed portion 242 is pressed inward (i.e. toward the support portion 274) in the pitch direction, a pressing force applied to the pressed portion 242 is transmitted to the support portion 274 through the biasing portion 244 so that the lock portion 272 is moved inward. More specifically, the hook 272*b* of the lock portion 272 is moved so as not to project out of the slit 252. In other words, the lock portion 272 is moved so that the lock portion 272 is located at a release position where the lock portion 272 is unable to be interlocked with engaged hole 160 of the connector 100. When the lock portion 272 is located at the release position, the lock portion 272 is entirely accommodated within the accommodating portion 250. The support portion 274 according to the present embodiment supports the lock portion 272 so that the lock portion 272 is movable between the lockable position and the release position.

When the lock portion 272 is located at the lockable position, the receiving portion 260 is located in the vicinity of the base 272*a* of the lock portion 272 so that the base 272*a* is interposed between the receiving portion 260 and the slit 252 in the pitch direction. As can be seen from the previous description, the receiving portion 260 according to the present embodiment is positioned so as to overlap with a passing region of the lock portion 272 where the base 272*a* of the lock portion 272 passes through when the lock portion 272 moves from the lockable position to the release position. Therefore, the projecting portion 144 is able to regulate a movement of the lock portion 272 in the pitch direction when the receiving portion 260 receives the projecting portion 144. In other words, the receiving portion 260 is designed so that the projecting portion 144 received in the receiving portion 260 regulates the movement of the lock portion 272 of the locking member 270 in the pitch direction. For example, the receiving portion 260 may be placed within a passing region of the support portion 274 where, not the lock portion 272, but the support portion 274 passes through when the lock portion 272 moves from the lockable position to the release position. Furthermore, the receiving portion 260 may be placed so as to partially overlap with the passing region of the support portion 274. The projecting portion 144 located to overlap with the passing region of the support portion 274 is regulatable the movement of the lock portion 272. However, it is more preferable to form the receiving portion 260 so as to overlap with the passing region of the lock portion 272 (for example, within the passing region of the lock portion 272). The projecting portion 144 received in the thus-formed receiving portion 260 may regulates the movement of the lock portion 272 more securely.

As shown in FIG. 8, the cover 280 includes two fitting arms 282 and two fixed portions 286. The two fitting arms 282 are formed on opposite ends of a rear part of the cover 280 in the pitch direction, respectively. Each of the fitting arms 282 extends downward. Each of the fitting arms 282 is formed with a hole 284. The two fixed portions 286 are formed on opposite ends of a front part of the cover 280 in the pitch direction, respectively. Each of the fixed portions 286 projects downward. The two fitting arms 282 correspond to the two fitting grooves 224 of the body 210, respectively. More specifically, the fitting arms 282 are able to be inserted into the respective fitting grooves 224 simultaneously. Similarly, the two fixed portions 286 correspond to the two receivers 222 of the body 210, respectively. Moreover, the fitting arms 282 are located on the respective fitting grooves 224 when the fixed portions 286 are located on the respective receivers 222. When the fitting arms 282 are inserted into the respective fitting grooves 224, the protrusions 226 are fitted into the respective holes 284 so that the fitting arms 282 are fitted with the respective fitting grooves 224.

According to the present embodiment, the FPC/FFC 50 is inserted into and connected to the connector 100 in a manner as described below.

At first, the FPC/FFC 50 is mounted on the mount portion 220 of the body 210 so that the two cuts 56 of the strengthened portion 54 are placed on the two receivers 222, respectively. Then, the fitting arms 282 are fitted with the fitting grooves 224 while the fixed portions 286 of the cover 280 are inserted into the receivers 222 through the cuts 56. The FPC/FFC 50 is interposed tightly between the body 210 and the cover 280. Moreover, a relative position of the FPC/FFC 50 relative to the holding member 200 is fixed by the fixed portions 286. In other words, the FPC/FFC 50 is held securely by the holding member 200. According to the present embodiment, the FPC/FFC 50 held by the holding member 200 is positioned properly relative to the connector 100 when the holding member 200 is positioned properly relative to the connector 100.

When the holding member 200 holding the FPC/FFC 50 is inserted into and mated with the connector 100 (i.e. when the holding member 200 is in the mated state), the terminals 52 of the FPC/FFC 50 are positioned properly relative to both the respective first contacts 110 of the connector 100 and the respective second contacts 120 of the connector 100. The locking member 270 according to the present embodiment is configured to be interlocked with the engaged hole 160 formed on the connector 100 under the inserted state. More specifically, the lock portion 272 of the locking member 270 is interlocked with the engaged hole 160 of the connector 100 when the lock portion 272 is located at the lockable position under the inserted state. The aforementioned interlock of the lock portion 272 of the locking member 270 with the engaged hole 160 locks the FPC/FFC 50 at a predetermined relative position of the FPC/FFC 50 relative to the connector 100. In other words, the FPC/FFC 50 is prevented to be moved from the predetermined relative position by the interlock of the locking member 270 with the engaged hole 160. When the FPC/FFC 50 is located at the predetermined relative position, the terminals 52 of the FPC/FFC 50 are positioned properly relative to both the respective first contacts 110 and the respective second contacts 120. Therefore, the FPC/FFC 50 according to the present embodiment is connectable properly to the connector 100 when located at the predetermined relative position.

When the actuator 140 is turned forward so as to be pivoted to the close position under the inserted state, the terminals 52 of the FPC/FFC 50 are connected to both the respective first contacts 110 and the respective second contacts 120. Thus, the connector 100 according to the present embodiment is connectable to the FPC/FFC 50 held by the holding member 200. The projecting portions 144 of the actuator 140 are received in and engaged with the receiving portion 260 of the body 210 of the holding member 200 when the actuator 140 is located at the close position. When the actuator 140 is located at the close position, it is possible to keep the predetermined relative position of the FPC/FFC 50 and to prevent the FPC/FFC 50 from being removed forcibly only by an engagement of the projecting portions 144 with the receiving portion 260. In other words, it is possible to keep the FPC/FFC 50 to be connected properly to the connector 100 by the engagement of the projecting portions 144 of the actuator 140 located at the close position. Moreover, according to the present embodiment, the interlock of the lock portion 272 made of a metal makes it possible to lock the predetermined relative position of the FPC/FFC 50 when the actuator 140 is located at the open position. Moreover, it is possible to lock the predetermined relative position of the FPC/FFC 50 more securely by the interlock of the lock portion 272 when the actuator 140 pivots to the close position. As described above, according to the present embodiment, the engagement of the projecting portions 144 with the receiving portion 260 and the interlock of the lock portion 272 with the engaged hole 160 keep the predetermined relative position of the FPC/FFC 50 relative to the connector 100.

The receiving portion 260 is positioned so that, when the receiving portion 260 receives the projecting portions 144 under a locked state where the locking member 270 is interlocked with the engaged hole 160, the projecting portions 144 received in the receiving portion 260 prevents the locking member 270 to be released from the engaged hole 160. More specifically, the projecting portion 144 received in the receiving portion 260 under the locked state prevents the lock portion 272 of the locking member 270 to move from the lockable position to the release position. In short, the projecting portion 144 prevents the lock of the lock portion 272 with the engaged hole 160 to be released. According to the present embodiment, unless the actuator 140 pivots to the open position, the lock of the lock portion 272 with the engaged hole 160 is not released unintentionally even if the pressed portion 242 is pressed inward.

The connector assembly according to the present invention is not limited to the connector assembly 10 according to the previously described embodiment.

According to the previously described embodiment, the actuator 140 is provided with the projecting portion (actuator-side engaged portion) 144 while the holding member 200 is provided with the receiving portion (holder-side engaged portion) 260. However, for example, the actuator 140 may be provided with a receiving portion (actuator-side engaged portion) while the holding member 200 is provided with a projecting portion (holder-side engaged portion).

According to the previously described embodiment, the receiver 222 is a through hole which pierces the mount portion 220. However, the receiver 222 needs not to pierce the mount portion 220, provided that the receiver 222 is properly receivable the fixed portion 286 of the cover 280.

The present application is based on a Japanese patent application of JP2010-202464 filed before the Japan Patent Office on Sep. 9, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A multi-piece holding member configured to hold a sheet-like or a board-like connecting object which is insertable into a connector including an actuator having an actuator-side engaged portion, said connecting object being connectable to the connector by turning over the actuator located at an open position when the connecting object is inserted into the connector, the holding member comprising:

a holder-side engaged portion configured to be engaged with the actuator-side engaged portion when the actuator is turned over in an inserted state where the connecting object held by the holding member is inserted into the connector, wherein the holder-side engaged portion is arranged to be apart from the actuator-side engaged portion when the actuator is located at the open position, and wherein an engagement of the holder-side engaged portion with the actuator-side engaged portion maintains a predetermined relative position of the connecting object relative to the connector.

2. The holding member as recited in claim 1, further comprising a locking member made of a metal, the locking member being configured to be interlocked with a connector-side lock portion formed on the connector when the connecting object is in the inserted state, and wherein an interlock of the locking member with the connector-side lock portion locks the connecting object at the predetermined relative position.

3. The holding member as recited in claim 2, wherein:

the actuator-side engaged portion is formed so as to project along a vertical direction when the actuator is turned over;

the holder-side engaged portion is formed as a receiving portion for receiving the actuator-side engaged portion when the actuator is turned over; and the receiving portion is positioned so that, when the receiving portion receives the actuator-side engaged portion in a state where the locking member is interlocked with the connector-side lock portion, the actuator-side engaged portion received in the receiving portion prevents the locking member from being released from the connector-side lock portion.

4. The holding member as recited in claim 3, wherein:

the locking member has a support portion and a lock portion;

the lock portion is supported by the support portion so as to be movable in a pitch direction perpendicular to the vertical direction between a lockable position where the lock portion is able to be interlocked with the connector-side lock portion and a release position where the lock portion is unable to be interlocked with the connector-side lock portion;

the holder-side engaged portion is positioned so as to overlap with a region where at least one of the support portion and the lock portion passes through when the lock portion moves from the lockable position to the release position; and the lock portion is interlocked with the connector-side lock portion when the lock portion is located at the lockable position when the connecting object is in the inserted state.

5. The holding member as recited in claim 4, wherein the holder-side engaged portion is configured so that the actuator-side engaged portion received in the holder-side engaged portion regulates a movement of the lock portion of the locking member in the pitch direction.

6. The holding member as recited in claim 4, wherein:

the lock portion has a base and a hook, the base being located between the holder-side engaged portion and the hook in the pitch direction, and the hook projecting outward in the pitch direction from the base.

7. A connector assembly comprising:

the holding member as recited in claim 1; and the connector connectable to the connecting object held by the holding member.

8. A connector assembly comprising:

the holding member as recited in claim 2; and the connector connectable to the connecting object held by the holding member.

9. A connector assembly comprising:

the holding member as recited in claim 3; and the connector connectable to the connecting object held by the holding member.

10. A connector assembly comprising:

the holding member as recited in claim 4; and the connector connectable to the connecting object held by the holding member.

11. A connector assembly comprising:

the holding member as recited in claim 5; and the connector connectable to the connecting object held by the holding member.

12. A connector assembly comprising:

the holding member as recited in claim 6; and the connector connectable to the connecting object held by the holding member.

13. A holding member configured to hold a sheet-like or a board-like connecting object which is insertable into a connector including an actuator having an actuator-side engaged portion, said connecting object being connectable to the connector by turning over the actuator when the connecting object is inserted into the connector, the holding member comprising:

a holder-side engaged portion configured to be engaged with the actuator-side engaged portion when the actuator is turned over in an inserted state where the connecting object held by the holding member is inserted into the connector, wherein an engagement of the holder-side engaged portion with the actuator-side engaged portion maintains a predetermined relative position of the connecting object relative to the connector; and a locking member made of a metal, the locking member being configured to be interlocked with a connector-side lock portion formed on the connector when the connecting object is in the inserted state, wherein an interlock of the locking member with the connector-side lock portion locks the connecting object at the predetermined relative position.

14. The holding member as recited in claim 13, wherein:

the actuator-side engaged portion is formed so as to project along a vertical direction when the actuator is turned over;

the holder-side engaged portion is formed as a receiving portion for receiving the actuator-side engaged portion when the actuator is turned over; and the receiving portion is positioned so that, when the receiving portion receives the actuator-side engaged portion in a state where the locking member is interlocked with the connector-side lock portion, the actuator-side engaged portion received in the receiving portion prevents the locking member from being released from the connector-side lock portion.

15. The holding member as recited in claim 14, wherein:

the locking member has a support portion and a lock portion;

the lock portion is supported by the support portion so as to be movable in a pitch direction perpendicular to the vertical direction between a lockable position where the lock portion is able to be interlocked with the connector-side lock portion and a release position where the lock portion is unable to be interlocked with the connector-side lock portion;

the holder-side engaged portion is positioned so as to overlap with a region where at least one of the support portion and the lock portion passes through when the lock portion moves from the lockable position to the release position; and the lock portion is interlocked with the connector-side lock portion when the lock portion is located at the lockable position when the connecting object is in the inserted state.

16. The holding member as recited in claim 15, wherein the holder-side engaged portion is configured so that the actuator-side engaged portion received in the holder-side engaged portion regulates a movement of the lock portion of the locking member in the pitch direction.

17. The holding member as recited in claim 15, wherein:

the lock portion has a base and a hook, the base being located between the holder-side engaged portion and the hook in the pitch direction, and the hook projecting outward in the pitch direction from the base.

18. A connector assembly comprising:

the holding member as recited in claim 13; and the connector connectable to the connecting object held by the holding member.

* * * * *